US008561362B2

(12) United States Patent
Dempsey

(10) Patent No.: US 8,561,362 B2
(45) Date of Patent: Oct. 22, 2013

(54) GROUND SECURING SYSTEM FOR A SOCCER GOAL

(75) Inventor: Gregory S. Dempsey, Glen Ellyn, IL (US)

(73) Assignee: Goal Alert LLC, Chicago, IL (US)

( * ) Notice: Subject to any disclaimer, the term of this patent is extended or adjusted under 35 U.S.C. 154(b) by 22 days.

(21) Appl. No.: 12/963,288

(22) Filed: Dec. 8, 2010

(65) Prior Publication Data

US 2011/0131895 A1 Jun. 9, 2011

Related U.S. Application Data

(60) Provisional application No. 61/285,130, filed on Dec. 9, 2009.

(51) Int. Cl.
*E02D 5/80* (2006.01)

(52) U.S. Cl.
USPC ..... 52/157; 52/173.1; 70/58; 248/545; 473/478

(58) Field of Classification Search
USPC ..... 52/155, 156, 157, 158, 159, 160, 161, 52/162, 163, 164, 165, 173.1, DIG. 11; 248/508, 545; 473/478; 70/57, 58, 234; 292/301, 302, 303, 304
See application file for complete search history.

(56) References Cited

U.S. PATENT DOCUMENTS 1,120,041 A * 12/1914 Dunn ..... 119/790
1,635,923 A * 7/1927 Bray ..... 52/157
3,076,532 A * 2/1963 Frye ..... 52/157
3,494,587 A * 2/1970 Kuhn ..... 248/499
3,517,469 A * 6/1970 Brown ..... 52/155
3,525,187 A * 8/1970 Vincent ..... 52/155
4,626,616 A * 12/1986 Masters ..... 174/37
4,923,165 A * 5/1990 Cockman ..... 248/545
5,094,423 A * 3/1992 Almquist et al. ..... 248/552
5,273,292 A * 12/1993 Pardi et al. ..... 273/400
5,501,086 A * 3/1996 Sherlock ..... 70/58

(Continued)

FOREIGN PATENT DOCUMENTS

FR 2819193 A1 * 7/2002
JP 2003144595 A * 5/2003

OTHER PUBLICATIONS

Notification Concerning Transmittal of International Prelminary Report on Patentability (Chapter I of the Patent Cooperation Treaty); PCT Written Opinion of the International Searching Authority—(Application No. PCT/US2009/066757; Filing Date: Dec. 4, 2009.

*Primary Examiner* — Basil Katcheves
*Assistant Examiner* — Rodney Mintz
(74) *Attorney, Agent, or Firm* — Factor Intellectual Property Law Group, Ltd.

(57) ABSTRACT

A selectively releasable ground securing device that includes a ground member, a clamp body, and a lock assembly that selectively cooperates with the ground member to secure the clamp body relative thereto. The ground member includes a drivable body that is constructed to be driven into a ground surface such that the ground member is generally flush with the upper layer of the ground surface. The lock assembly selectively cooperates with the ground member to secure the clamp body and structure engaged therewith relative to the ground member. In a preferred embodiment, the clamp body cooperates with a rail of a goal assembly to prevent tipping or movement of the goal assembly when the lock assembly is engaged with the ground member.

9 Claims, 6 Drawing Sheets

(56) References Cited

U.S. PATENT DOCUMENTS

| | | | | |
|---|---|---|---|---|
| 5,599,024 | A * | 2/1997 | Acuff et al. | 473/478 |
| 5,813,259 | A * | 9/1998 | Martin | 70/234 |
| 5,820,497 | A * | 10/1998 | Pena | 473/471 |
| 5,832,755 | A * | 11/1998 | Crilly | 70/58 |
| 5,855,129 | A * | 1/1999 | Warren et al. | 70/234 |
| 6,082,697 | A * | 7/2000 | Grunfeld | 248/508 |
| 6,272,798 | B1 * | 8/2001 | Cockman | 52/155 |
| 6,334,281 | B1 * | 1/2002 | Oliver et al. | 52/157 |
| 6,481,364 | B2 * | 11/2002 | Woyjeck | 114/294 |
| 6,629,389 | B1 * | 10/2003 | Rust | 52/157 |
| 6,641,332 | B1 * | 11/2003 | Alvarado | 405/232 |
| 6,886,376 | B2 * | 5/2005 | Kuo | 70/58 |
| 7,331,880 | B2 * | 2/2008 | Rogers | 473/478 |
| 7,409,842 | B2 * | 8/2008 | Kuo | 70/58 |
| 7,409,915 | B2 * | 8/2008 | Hagar | 109/50 |
| 7,527,569 | B2 * | 5/2009 | Rogers | 473/478 |
| 7,559,218 | B2 * | 7/2009 | Soudan, Jr. | 70/63 |
| 7,712,763 | B2 * | 5/2010 | Lovenberg | 280/507 |
| 7,828,678 | B1 * | 11/2010 | Caruso | 473/416 |
| 8,172,705 | B2 * | 5/2012 | Rogers | 473/478 |
| 8,220,209 | B2 * | 7/2012 | Roy et al. | 52/156 |
| 8,234,995 | B2 * | 8/2012 | Dempsey | 116/303 |
| 2006/0199674 | A1 * | 9/2006 | Rogers | 473/446 |
| 2007/0000187 | A1 * | 1/2007 | St. Onge et al. | 52/157 |
| 2007/0144081 | A1 * | 6/2007 | Caruso | 52/155 |
| 2007/0283732 | A1 * | 12/2007 | Soudan | 70/63 |
| 2008/0006756 | A1 * | 1/2008 | Mitchell et al. | 248/545 |
| 2008/0207361 | A1 | 8/2008 | Rogers | |
| 2008/0264119 | A1 * | 10/2008 | Thomas | 70/77 |
| 2009/0007502 | A1 * | 1/2009 | Roy et al. | 52/159 |
| 2009/0152419 | A1 * | 6/2009 | Wallace | 248/219.4 |
| 2009/0197709 | A1 * | 8/2009 | Rogers | 473/478 |
| 2010/0147207 | A1 * | 6/2010 | Dempsey | 116/209 |
| 2011/0005148 | A1 * | 1/2011 | Foster | 52/157 |
| 2011/0098139 | A1 * | 4/2011 | Query et al. | 473/478 |
| 2011/0098140 | A1 * | 4/2011 | Query, Jr. | 473/478 |
| 2012/0036797 | A1 * | 2/2012 | Ardern | 52/157 |
| 2012/0160139 | A1 * | 6/2012 | Pearce | 109/52 |
| 2012/0252606 | A1 * | 10/2012 | Ennis | 473/478 |
| 2013/0014691 | A1 * | 1/2013 | Dempsey | 116/209 |

* cited by examiner

GROUND SECURING SYSTEM FOR A SOCCER GOAL

CROSS-REFERENCE TO RELATED APPLICATIONS

This application claims priority to U.S. Provisional Patent Application No. 61/285,130 filed on Dec. 9, 2009 titled "Ground Dock And Lock" and the disclosure of which is expressly incorporated herein.

BACKGROUND OF THE INVENTION

The present invention relates generally to ground securing systems and, more specifically, to a device for selectively anchoring or securing objects to the ground. More particularly, the present device relates to a docking or locking system for selectively securing moveable sport goals and the like to the ground and a lock to prevent unintentional or unauthorized interference or movement of the sporting device.

Soccer is one of, and perhaps the most popular sport in the world. In some instances, soccer goals are fixed, or set securely (permanently or semi-permanently) into the ground. In other instances, soccer fields can be shared (e.g., also used as lacrosse fields), and as such the goals are moveable. Regardless of the particular use of a sporting field, it is commonly more efficient or expedient for grounds personnel to move the goal structures to attend to field maintenance and/or preparation.

Regardless of the particular event, many upright sporting structures are susceptible to unintended or unintentional movement. Many movable goals commonly require counterweight systems, such as sandbags or the like, to reduce the potential of unintended and/or undesired tipping or movement of the goal structures. Still other secured systems require in-ground securing structures that are permanently engaged with the game field. Such securing systems have several drawbacks.

Less permanent or transportable goal counterweight systems are susceptible to improper use and/or installation and/or vandalism. Improperly placed counterweight systems do not perform their intended purpose of limiting unintended goal movement. More permanent goal securing systems limit the sporting configurations that can be attained with a respective game field. That is, the goal systems, if removable at all, must be located in the same orientation and location each time a field is to be used. Further, such permanent ground securing systems present a lowly visible hazard in a particular game field when goals are not positioned proximate the securing system. Inadequately positioned securing systems present a further hazard to grounds personnel and equipment commonly responsible and necessary for maintaining such fields of play.

Another factor common to improper anchoring techniques is the commonly available hand and power tools associated with manipulation of the securing systems. A number of goal securing systems utilize a sledgehammer for installation and a crowbar or other prying device for removal. Such tools are often not present when needed by those responsible for goal management and/or have functionality that can be improvised with other tools by those unauthorized to alter the position of a given goal.

Furthermore, each time such securing systems are placed and/or removed, the ground associated with the securing device is disturbed and is thereby weakened which detracts from secure interaction of the securing device and the ground surface and can compromise the intended anchoring of the goal structure. The repeated placement and removal of such securing systems also detracts from the preferred uniform condition and appearance of the game field regardless of the goal location.

Not limited to sporting event goal structures, many upright or other structures are susceptible to unintended or undesired movement due to interaction with repeated or unintended forces and/or interference. Many people, including many rural residents, appreciate the ability to periodically secure structures in some manner to a ground surface. Such uses can include cloth or tarp covered structures commonly used for covering vehicles or other materials that are intended to be protected from the elements. Many such closure systems commonly includes a cloth or tarp that is tensioned over a wire frame or tube structure. Much like the closures commonly also associated with ice fishing activities, even moderate winds tend to interfere with the desired positioning of such structures.

Accordingly, there is a need for a device that allows for an object, such as a sporting goal or otherwise freestanding structure, to be secured and locked to a surface, such as the ground. There is a further need for a selectively operable interface with the securing system to prevent undesired interference with the ground securing system. There is a further need for a ground securing system that can be quickly and conveniently positioned and repositioned as needed. There is a further need for a ground securing device that is all but invisible when a securing structure is removed therefrom so as to not interfere with the persons or machines that may pass thereover when the structure or securing structures are removed from the ground engaging device such as during storage or non-use of the structure and/or temporary designation of a given area for another use. Preferably, such a securing system permits unlocking and moving the object without disturbing the ground engaging portion of the device. More preferable still, such a device permits adjusting the placement and location of an object or structure intended to be secured.

SUMMARY OF THE INVENTION

The present invention provides a ground securing system that overcomes one or more of the aforementioned drawbacks. One aspect of the invention discloses a selectively releasable ground securing device that includes a ground member, a clamp body, and a lock assembly that selectively cooperates with the ground member to secure the clamp body relative thereto. The ground member includes a drivable body that can be driven into a ground surface. Preferably, the ground member has a rod or fluted shape selected to correspond to the prevalent conditions associated with the ground surface associated with a given geographic region. The ground member is also preferably constructed to be generally flush with the upper layer of the ground surface when the ground member is fully engaged therewith. The ground securing device also includes a removable or selectively operable cover to limit water, dirt, or debris from interfering with operation of the securing device. The lock assembly selectively cooperates with the ground member to secure the clamp body, and structure engaged therewith, relative to the ground member. In a preferred embodiment, the clamp body cooperates with a rail of a goal assembly to prevent tipping or movement of the goal assembly when the lock assembly is engaged with the ground member.

Another aspect of the invention that is usable with one or more of the above aspects discloses a mounting system for selectively fixing structures to a ground surface. The mounting system includes a ground engaging member having a first end that is adapted to guide the ground engaging member into a ground surface and a second end that is adapted to be positioned proximate an upper surface of the ground surface. A lock assembly removably engages the second end of the ground engaging member. The mounting system includes a clamp body that is constructed to extend in a lateral direction relative to a longitudinal axis of the ground engaging member. The clamp body is further constructed to be removable from the ground engaging member only when the lock assembly is disengaged therefrom.

Another aspect of the invention usable with one or more of the features or aspects described above includes a ground clamp assembly. The ground clamp assembly includes a ground member that is constructed to be driven into the ground. A lock member is selectively securable to the driven member. A clamp member extends in an outward direction from the ground member and is shaped to cooperate with a structure to be secured. The clamp member is selectively securable to the ground member by the lock member to prevent undesired translation of the structure to be secured relative to the ground surface.

Another aspect of the invention that is usable with one or more of the above features or aspects includes a method of selectively securing a structure to a ground surface. The method includes driving a ground member into the ground. A clamp body is aligned with the ground member to interfere with the structure to be secured. A removable lock engages the ground member to secure the clamp body to the ground member and thereby securing the structure relative thereto.

BRIEF DESCRIPTION OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE PREFERRED EMBODIMENT

Figure 1:
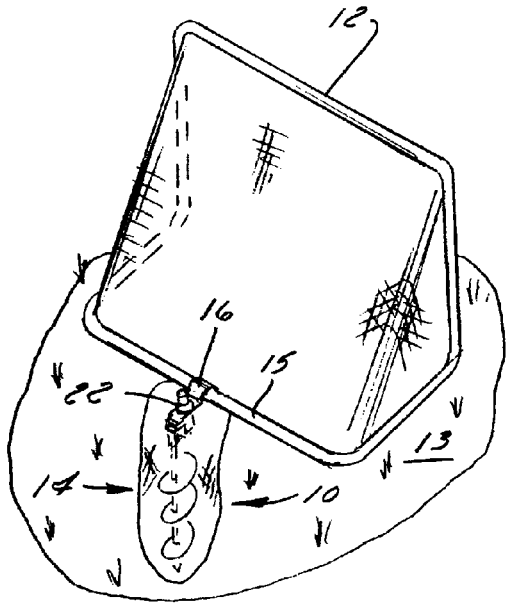
FIG. 1 is a rear perspective view of a soccer goal secured to a ground surface with a ground securing system according to one embodiment of the present invention.

FIG. 1 shows a ground securing system 10 according to one embodiment of the present invention securing a structure, such as a soccer goal 12, relative to a ground surface 13. Although ground securing system 10 is shown proximate a rear ground bar or rear ground shoe 16 of soccer goal 12, it is appreciated that ground securing system 10 can be positioned to engage any of the rigid members of goal 12. Preferably, ground securing system 10 interacts with the structure to be supported in a manner that does not interfere with use of the structure. For instance, when securing a goal or other sporting device, ground securing system 10 is preferably located outside the intended field of play. It is further appreciated that although only one ground securing system 10 is shown engaged with goal 12, more than one securing system 10 can be utilized when desired or necessary. Understandably, use of one or more ground securing systems will depend largely on the shape of the structure being secured and the loads the structure is intended to withstand.

Figure 2:
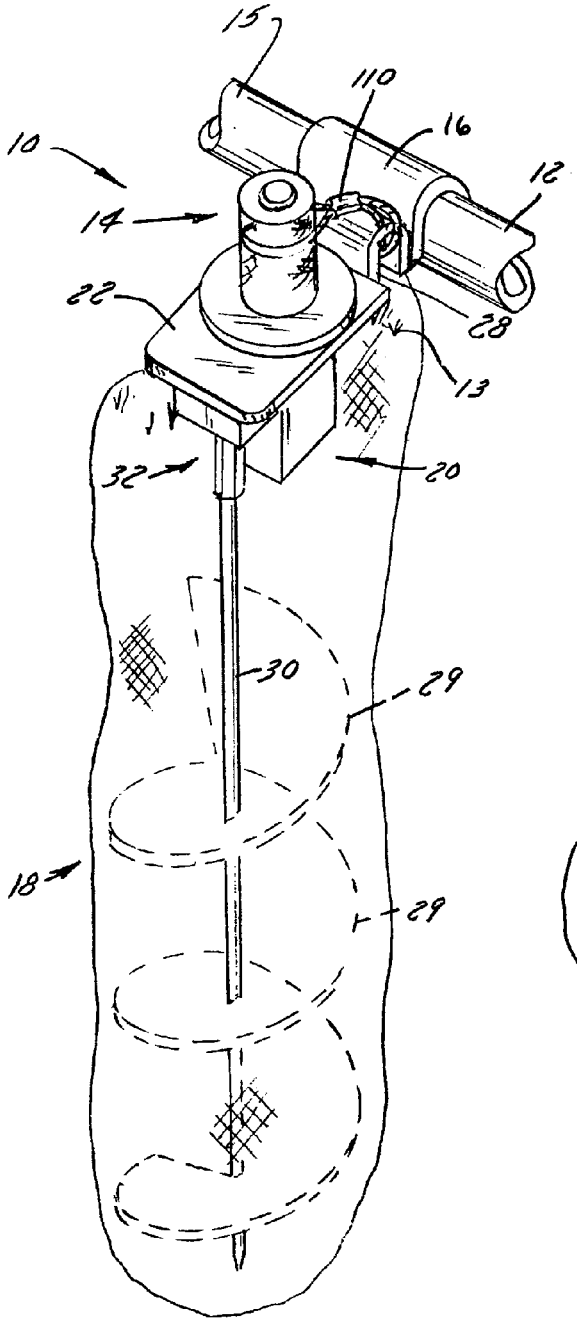
FIG. 2 is a rear perspective view of the ground securing system shown in FIG. 1.

Referring to FIGS. 1 and 2, ground securing system 10 includes a ground penetrating/engaging element or member 18, a lock or lock housing 20, a clamp body or structure engaging member or housing/anchor flange 22, and a lock carriage 24. A locking pin 21 is fitted into the lock carriage and lock housing 20. A clamping member or mounting bracket 28 is secured between the lock carriage 24 and the housing/anchor flange 22 and extends in an outward lateral direction to interact with goal 12.

The ground penetrating/securing element 18 can be any type of structural anchor. For example, an auger is one such contemplated anchor. Deep seated stakes may also be used. The specific type of anchor used will depend upon a variety of conditions, such as the type of soil (for example, clay, sand, or the like), the depth of penetration available for the anchor, weather conditions, and the like. In a present embodiment, ground engaging member 18 includes a number of threads or flutes 29 that extend in an outward radial direction from a longitudinal body 30 of member 18. Member 18 includes a securing portion 32 for engaging the lock housing. In one embodiment, securing portion is configured as a threaded opening 36 in a top portion of the anchor or ground engaging member 18. Although member 18 is removable, it is intended to be left in place once installed in ground surface 13 relative to a playfield and selectively engageable with the mounting bracket 28 such that the mounting bracket 28 can be removed therefrom to allow movement of goal 12.

Figure 3:
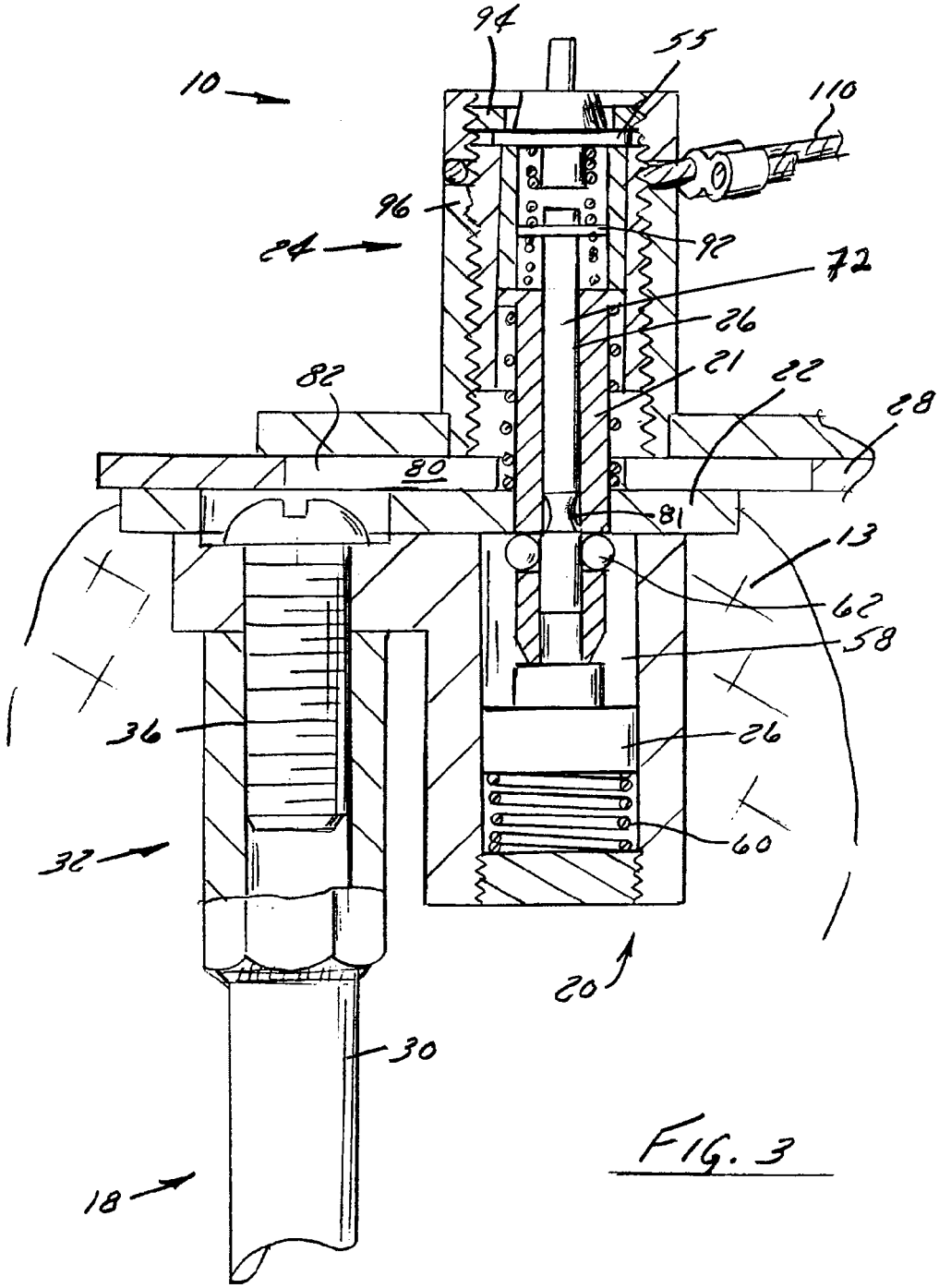
FIG. 3 is cross-sectional view of the ground securing shown in FIG. 2.
Figure 4:
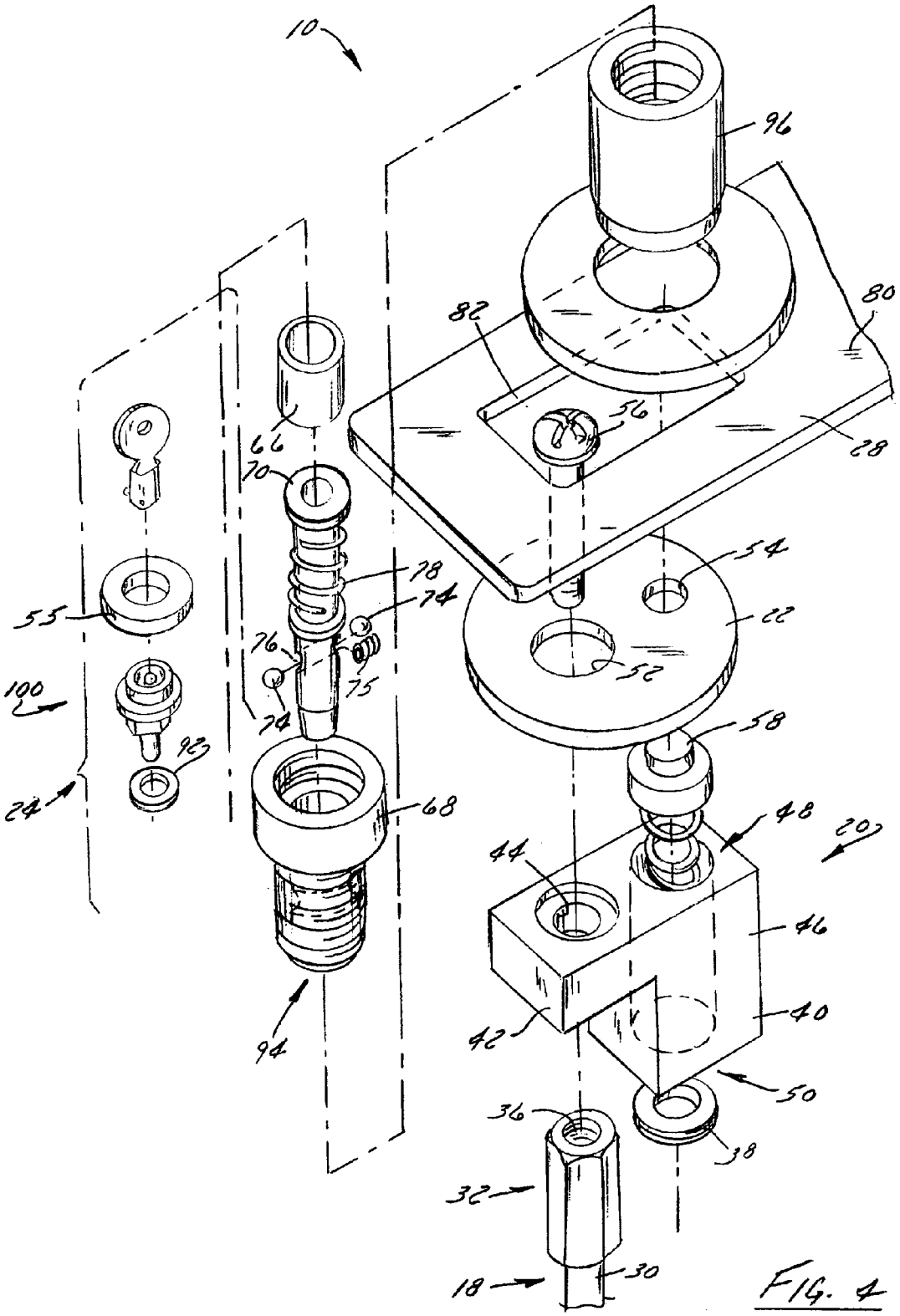
FIG. 4 is an exploded view of the ground securing system shown in FIG. 2.

Referring to FIGS. 2-4, lock housing 20 is secured to the anchor member 18 and is also intended to be left in place relative to the playfield. Lock housing 20 includes a stepped body 40 having a first shallow tier 42 with an opening 44 therethrough. A second, deeper tier 46 includes a lock cavity 48. The lock cavity is configured to selectively receive locking pin 26. Lock cavity 48 is preferably a through-bore in the housing to accommodate greater manufacturing efficiencies. A lower end 50 of the bore can be fitted with a seal and/or plug 38 to prevent the introduction of water and debris into the lock cavity.

The housing/anchor flange 22 is mounted to the top of the housing. Preferably, flange 22 is also intended to be left in place once installed in the ground by being mounted to the housing. The flange includes two openings 52, 54. One opening 52 aligns with the bore for the anchor and the other opening 54 aligns with the lock cavity 48. The anchor bore opening can be recessed, so that a shoulder bolt 56 or the like can be inserted through the opening and threaded into the end of the anchor. In this manner, the recessed bolt head is generally flush with the top of the flange.

The opening 54 over the lock cavity 48 forms part of the cavity and includes a polymeric, such as DELRIN®, or like member 58 that seals the upper portion of the cavity 48. A spring 60 in the cavity urges the seal to the closed state to reduce the incidence of dirt or debris collecting in cavity 48. Cavity 48 includes a circumferential shoulder or groove 62 formed in the wall below the top surface of the housing.

Cavity 48 can also be formed as a bore in the lock housing. Optionally, a sleeve (not shown) can be inserted into the cavity to help form or define the cavity. As will be discussed below, the sleeve can be formed from a stainless steel material for increased strength.

Referring to FIGS. 3-4, lock carriage 24 includes, a spindle or locking pin 21, a lock sleeve 66 and a lock flange 68 mounted to the bottom of the sleeve, through which locking pin 26 is inserted. The pin lock is of a type of ball lock pin having a tubular body 70, a plunger 72, and balls 74 that are movable into and out of openings 76 formed in the sidewall of the body of locking pin 21 as controlled by the position of balls 74 relative to groove 81 formed in plunger 72. Balls 74 are maintained in the outward orientation by engagement with the plunger 72 which is biased by a spring 78 in the body (as shown in FIG. 3) or via an alternate spring 75 disposed between the pair of balls 74 and supported in a cavity 76 formed in body 70 (as shown in FIG. 4). The plunger 72, or an extension thereof, which in the present lock extends from the top of the body, is biased to maintain the balls 74 in the outward state extending through openings 76 or in a generally outward direction relative to the body 70 of spindle or pin 21. Referring to the arrangement shown in FIG. 3, depressing plunger 72 against a spring bias moves the plunger such that the balls "fall" into a recess 81 in the plunger 72, which releases the balls 74 from the wall openings 76 to allow them to move inwardly so as to not extend beyond an outer surface of the body. Releasing the plunger 72 moves the plunger so that the recess 81 no longer aligns with the balls and the balls 74 protrude outwardly relative to pin 21. Said in another way, when plunger 72 is released, the balls are biased to seat proud of the external surface of the locking pin 21 and interfere with the structures positioned proximate thereto and interfere therewith to thereby prevent axial translation of locking pin 21 relative to the adjacent structure. When engaged with cavity 48, balls 74 engage groove 62 so as to secure the structure engaging member 28 relative to the ground engaging member 18.

A spring, or a lock outer spring 78, is located around the outside of the body, captured between the lock flange 55 and a washer 92. Washer 92 is mounted to the body, but can be urged upward, toward the lock flange 55, against the spring bias, as when the lock is in place in the housing. Such an orientation provides a positive secured bias for maintaining the engagement of the lock with the cavity.

The lock sleeve is formed from an upper body 94 and a lower body 96. The upper body 94 threads into lower body 96. The locking pin is mounted to the upper body and can thus be moved or adjusted up and down, relative to the lower body (and thus the flange) by threadedly engaging (or disengaging) the upper and lower body sections. In this manner, the locking pin 21 is retained tight between the lock flange 55 and washer 92, even when the lock is adjusted up or down, by the compression of the spring.

In a preferred aspect, the locking pin can be configured with a key lock 100 that interacts with the portion of the plunger that extends from the top of the upper body. The key lock prevents unintended and/or unauthorized interaction with the plunger to unlock the locking pin from the housing.

In a present application, the ground lock and dock is used in conjunction with the goal mounting bracket 22. The mounting bracket includes a portion that is affixed to the goal 12 (such as by bolts) and a portion 80 that cooperates with the ground securing system 10. As illustrated, the goal mount portion can be configured having an inverted U-shape or a bent leg that captures the ground bar or is affixed (e.g., bolted) to the ground bar.

The lock and dock portion 80 of the flange 22 includes an opening 82 through which the lock carriage (locking pin 21) can be inserted. In a present bracket, the opening 82 is formed as a window with an opening that is sufficient in size to allow for limited adjustment to the location of the goal relative to ground engaging member 18. In this manner, the housing and anchor can be installed in the ground and the bracket installed on the goal to a desired location within about +/−2 inches and the final location adjustment can then be made when locking the goal down. Preferably, flange 22 cooperates with ground engaging member 18 in a manner that allows limited movement of goal 12 relative thereto but in a manner that also prevents removal of goal 12 therefrom via passage of the goal member 15 under the U-shaped portion of the clamp body. Such a construction allows the goal to provide some movement of the goal in a generally lateral direction should players inadvertently come in contact with the goal during game play.

It is anticipated that the lock and dock will be fabricated from high strength, corrosion-resistant materials, such as aluminum or the like. Where necessary, for example, where stresses are anticipated to be very high, such as at the lock housing cavity walls/shoulder, alternate materials, inserts or the like of higher strength materials (such as stainless steel) can be used to prolong the life of the lock and dock.

To install the lock carriage, the plunger is depressed to allow the balls to "float" inward. The lock carriage is positioned with the pin extending through the bracket window and into the lock cavity in the housing/anchor flange. The pin is urged downward into the cavity to move the seal downward (against the spring). Once in place, the plunger is released, which locks the balls in the recess in the cavity and locks the pin in place. The key lock can then be used to lock the pin in the lock housing. When the pin is inserted into the cavity, the washer is urged upward, by engagement with the housing/anchor flange, against the spring bias. This maintains a tension on the pin lock to assure good contact with the lock housing. To remove the pin lock, the key lock is unlocked, the plunger is depressed and the pin is pulled upward to remove it from the cavity. The seal in the cavity closes against the cavity inner wall (lip) to prevent the introduction of debris into the cavity.

In the illustrated embodiment, one end of a tether such as a cable 110 is attached to the locking pin. The other end of the cable can be secured to the bracket or to the lock housing or the goal to prevent misplacement of the pin lock.

It is appreciated that when in position, the pin extends through the window opening and the lock flange rests on top of the bracket. The over-size of the lock flange relative to the window opening prevents the bracket (and the attached goal) from being lifted up and over, or around the window. Such a configuration allows goal 12 to interact with the clamp body when the goal is positioned proximate rather than exactly at a given position relative to the ground engaging member during intermittent removal or temporary movement of the goal 12.

In use, a desired location for the ground lock and dock is selected. The anchor is driven into the ground. An area sufficient in size to accommodate the lock housing and housing/anchor flange is cleared around the anchor and the lock housing is mounted (by a shoulder bolt or the like) to the housing. The goal is moved into position with the bracket window overlying the lock housing. As described above, the pin lock is inserted into the cavity and locked placed therein. Such a configuration provides a ground mounting system that can be quickly and conveniently located and installed and which allows expedient removal and replacement of the goal relative thereto without interfering or otherwise altering the location of the ground engaging member of the mounting system.

It will be appreciated that the lock and dock can be used with any type of object that is to be mounted to a surface. Although the exemplary use is for a soccer goal, many other objects, such as temporary storage shelters, are contemplated with which the present device can be used. The lock and dock can also be used on vertically oriented surfaces, so long as the lock housing can be installed or otherwise secured to a mounting surface, and all such uses are within the scope and spirit of the present disclosure.

FIGS. 5-9 show a mounting system 200 according to another embodiment of the present invention. Mounting system 200 includes a ground engaging member 202, a structure clamp member or body 204, and a lock assembly 206 that removably cooperates with one or both of ground engaging member 202 and clamp body 204. Ground engaging member 202 includes an elongated body 208 that extends from a downward facing first end 210 to an upward facing second end 212. Although elongated body 208 is shown as having a generally cylindrical or rod shape, it is further appreciated that a number of flutes, flights, or veins, such as those shown in FIG. 2, could be helically wound about body 208. It is appreciated that such structures typically convert a rotational driving force into a longitudinally or axially directed driving force. Understandably, ground engaging member can also be linearly driven into a ground surface via use of hammer type tools with or without rotational operation of the hammer system. It is further appreciated that such structures provide a desired holding force for engagement of ground engaging member 202 with surrounding soil conditions.

Figure 8:
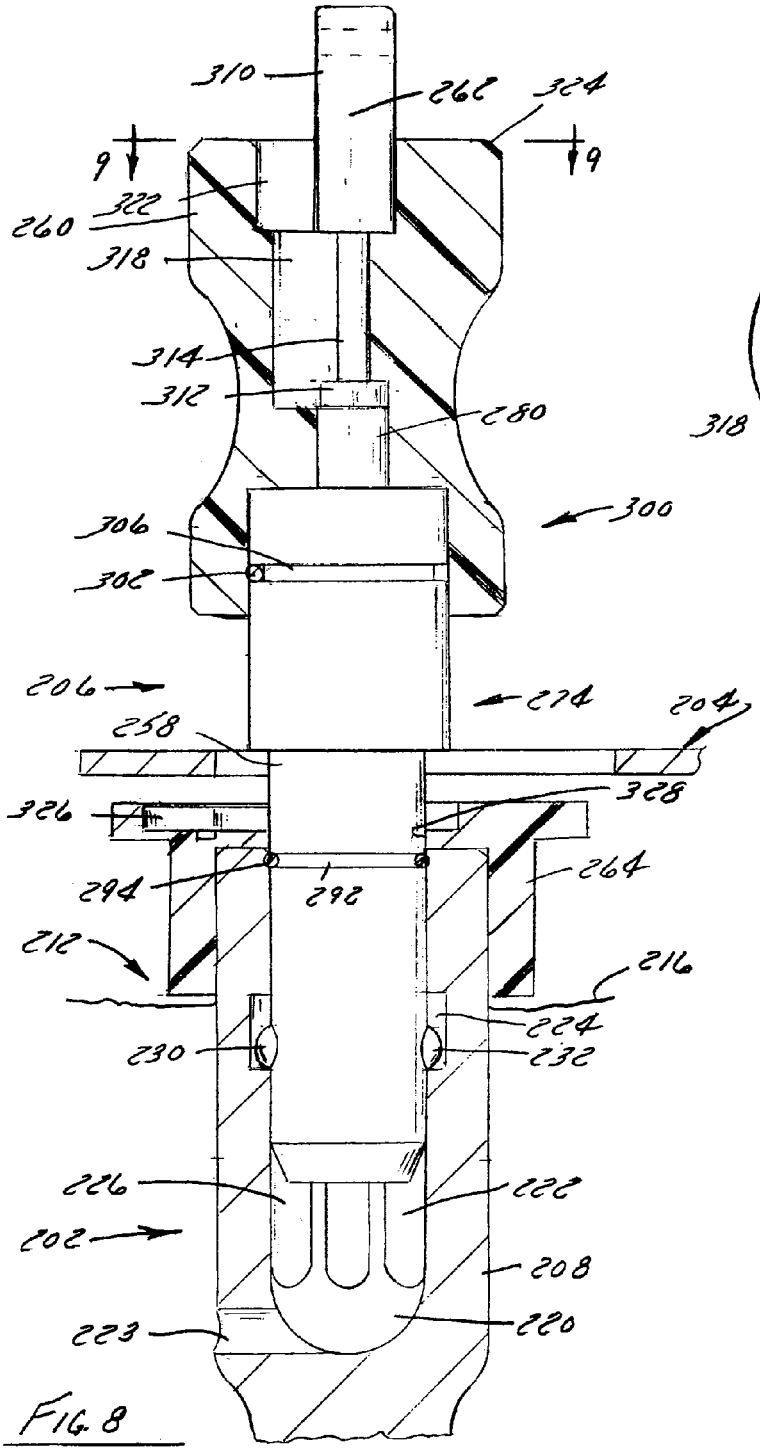
FIG. 8 is a cross-sectional view of the ground securing system shown in FIG. 5.

First end 210 of ground engaging member 202 is configured to guide ground engaging member 202 into a ground surface 214 to a depth whereat second end 212 of body 208 of ground engaging member 202 is positioned proximate in upper surface or top layer 216 of ground surface 214. As shown in FIG. 8, a cavity 220 is formed in second end 212 of body 208 of ground engaging member 202. Cavity 220 includes a contour 222 that is shaped to cooperate with a rotational or linear drive system or tool. Preferably, contour 222 is shaped to cooperate with a standard drive system applicable to many power tools such as a three eights inch or half-inch rotational drive common to many impact and rotational hand drive tools. It is appreciated that contour 222 could have virtually any size and shape selected to cooperate with a given more specific or unique drive tool. It is further appreciated that contour 222 could be external to ground engaging member 202 so common drivers such as standard and/or metric sockets could be used to drive the ground engaging member.

Ground engaging member 202 includes a channel 224 that is formed in an interior wall 226 of cavity 220 and is offset from the lower end thereof. As explained further below, channel 224 is shaped to removably secure a locking mechanism 258 to ground engaging member 202 when the locking mechanism is engaged with cavity 220. Ground engaging member 202 further includes a weep hole 223 fluidly connected to cavity 220. Weep hole 223 is shaped and positioned to drain debris or water from cavity 220. Preferably, weep hole 223 is positioned at the lowermost point of cavity 220 and extends fully through the body of the ground engaging member to atmosphere even though hole 223 is preferably positioned below the upper or top surface of ground surface 214

Figures 5, 6:
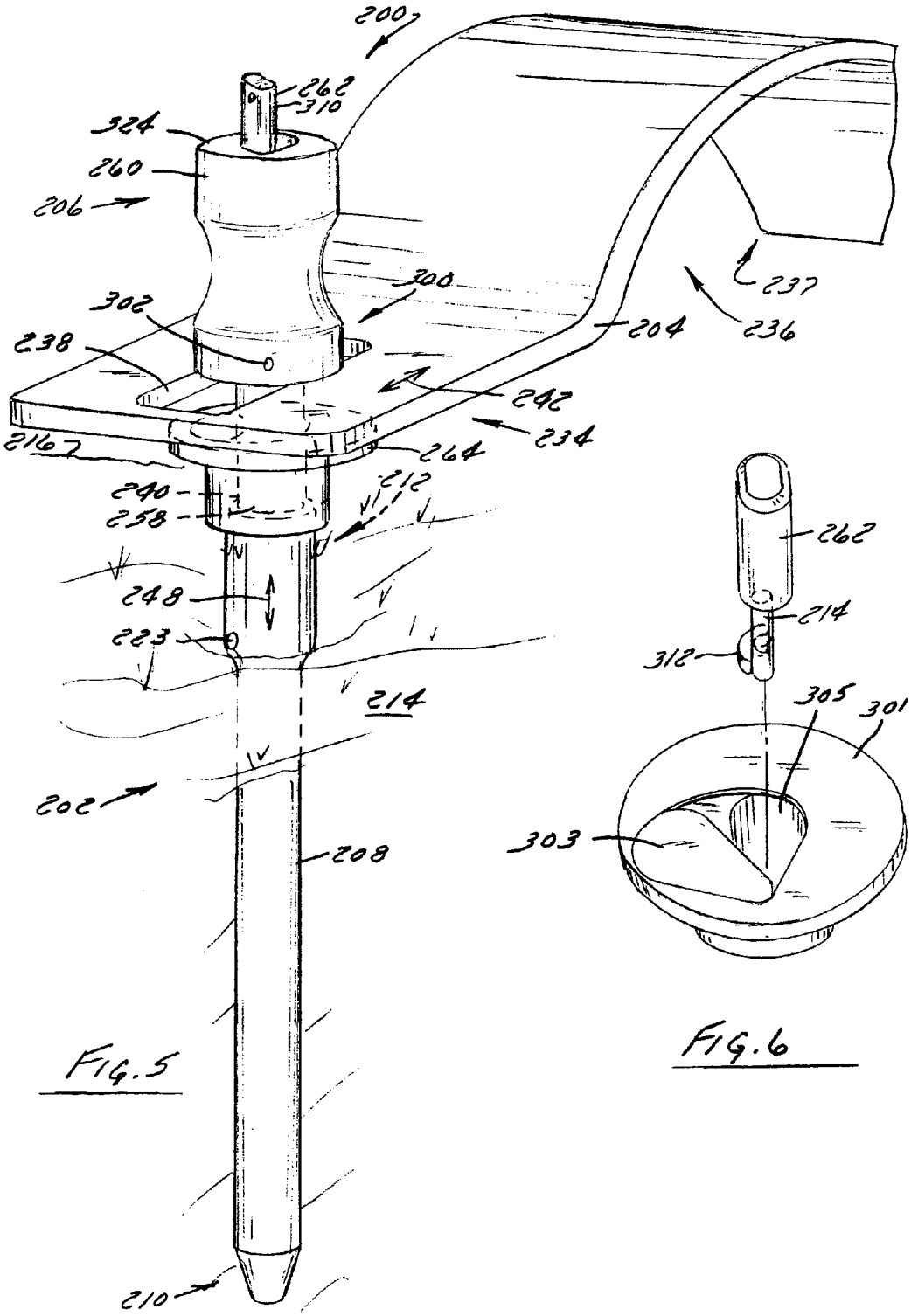
FIG. 5 is a perspective view of a ground securing system according to another embodiment of the present invention.
FIG. 6 is a top perspective view of an optional cap configured to cooperate with the lock mechanism of the ground securing system shown in FIG. 5.
Figure 7:
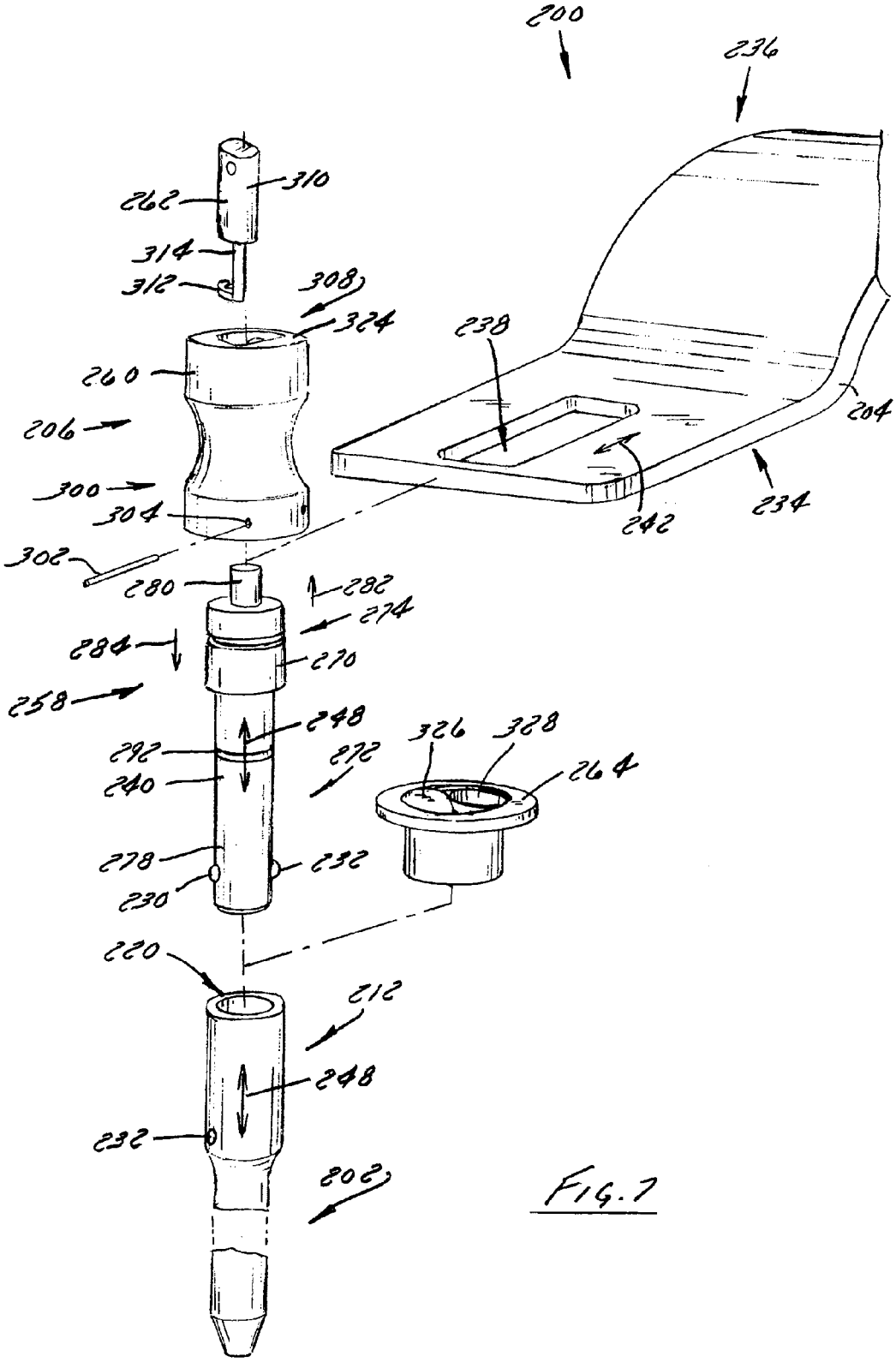
FIG. 7 is a partial exploded view of the ground securing system shown in FIG. 5.

An optional cap or cover 264 is also provided to maintain the operative integrity of cavity 220. Referring to FIGS. 5 and 7, optional cover 264 can be engaged about the blind opening of cavity 220. Cover 264 includes a rotatable cap or lid 326 that selectively exposes a passage 328 through cover 264. Passage 328 is shaped to accommodate slidable and rotational interaction of a lock mechanism 258 with cavity 220 of ground securing member 202. Closing lid 326 prevents the collection of fluids, dirt, or debris in cavity 220 when locking mechanism is not engaged therewith. It is further appreciated that cover 264 can be brightly colored or otherwise configured to provide a visual indication as to the location of the ground securing member 202. Cover 264 can be constructed to slidably cooperate with ground securing member 202 or can be integral with ground securing member 202, removable therefrom, or otherwise permanently secured thereto.

Referring to FIGS. 5 and 7, clamp body 204 includes a first portion 234 and a second portion 236 that extends from first portion 234. First portion 234 of clamp body 204 as a generally planar shape whereas second portion 236 of clamp body 204 extends in an arcuate manner to define a cavity 237 shaped to capture a portion of the structure intended to be secured to the ground surface 214, such as a horizontal leg of a sporting device such as a soccer goal. Understandably, clamp body 204 could have virtually any shape selected to interact with a structure intended be secured.

An opening 238 is formed in the first portion 234 of clamp body 204 and shaped to receive a stem portion 240 of lock assembly 206. Opening 238 is preferably elongated to allow translation of clamp body 204 in a lateral direction, indicated by arrow 242, relative to stem portion 240 of a lock mechanism 258. Such a construction allows restricted movement of clamp body 208 relative to a longitudinal axis, indicated by arrow 248, of stem portion 240 of lock assembly 206 and ground engaging member 202. Such a configuration allows clamp body 204 to be fully rotatable about stem portion 240 of lock assembly 206 and provides inwardly and outwardly directed lateral translation of clamp body 204 relative to the longitudinal axis 248 of ground engaging member 202. Such a configuration allows clamp body 204 to loosely rather than rigidly secure a structure to be secured when the structure is positioned only in close proximity to mounting system 200 rather than being repeatedly positioned at a specific location relative to ground engaging member 202.

Referring to FIGS. 5, 7, and 8, lock assembly 206 includes a lock mechanism 258, an optional bobbin 260, and an optional key 262. As shown in FIG. 7, lock mechanism 258 includes an elongate body 270 having a first portion 272 and a second portion 274. First portion 272 of lock mechanism 258 is shaped to slidably pass through cover 264 and cooperate with cavity 220 formed in ground engaging member 202. Balls 230, 232 extended in an outward radial direction from an outer surface 278 of lock mechanism 258. First portion 272 of lock mechanism 258 is also shaped to slidably pass through opening 238 formed in clamp body 204.

Second portion 274 of lock mechanism 258 is wider than first portion 272 such that second portion 274 cannot pass through opening 238 formed in clamp body 204. A plunger 280 extends in an upward direction from second portion 274 of lock mechanism 258. Plunger 280 slidably cooperates with body 270 of lock mechanism 258 much like the construction shown in FIG. 3 and as described above. A spring (not shown) is disposed between plunger 280 and body 270 and biases plunger 280 in an upward direction, indicated by arrow 282, relative to body 270. Pressing of plunger 280 in a downward direction, indicated by arrow 284, aligns a detent (not shown) formed on plunger 280 proximate balls 230, 232 such that balls 230, 232 are allowed to retract to a position inboard of outer surface 278 of body 270. Much like the arrangement of plunger 72, balls 62, and pin 21 shown in FIG. 3, depression of plunger 280 and the inward deflection of balls 230, 232 allows longitudinal translation of lock mechanism 258 relative to ground engaging member 202 via the non-interfering engagement of balls 230, 232 with channel 224 formed in cavity 220 of ground engaging member 202 as shown in FIG. 8.

Stem portion 240 of lock mechanism 258 includes a groove 292 formed on surface 278 and offset in an upward direction relative to balls 230, 232. A gasket, such as an O-ring 294, is disposed in groove 292 and sealing interacts with an opening associated with cavity 220 of ground engaging member 202. Such interaction maintains the operational integrity of balls 230, 232 when lock mechanism 258 is engaged with channel 224. Lock mechanism 258 secures clamp body 204 relative to ground engaging member 202 when first portion 272 is passed through opening 238 of clamp body 204 and slidably associated with cavity 220 of ground engaging member 202 such that balls 230, 232 enter an interfering engagement with channel 224 formed in cavity 220 of ground engaging member 202. Depression of plunger 280 allows removal of lock mechanism 258 from ground engaging member 202 such that clamp body 204 can be disengaged from one or both of the lock mechanism 258 and ground engaging member 202. An optional snap ring or nut assembly could also be provided to secure clamp body 204 to lock mechanism 258 such that clamp body 204 and lock mechanism can be rendered loosely connected to one another and/or otherwise rendered inseparable without the use of extraneous effort and/or tools.

Lock assembly 206 includes an optional bobbin 260 and an optional key 262 to prevent or mitigate undesired or nefarious interaction with mounting system 200. Bobbin 260 includes a first portion that slidably interacts with second portion 274 of lock mechanism 258. A roll key or pin 302 interacts with a passage 304 formed through first portion 300 of bobbin 260. As shown in FIG. 8, roll pin 302 cooperates with a groove 306 formed in the second portion 274 of lock mechanism 258. Alternatively, bobbin 260 could be press fit and/or shrink fitted to lock mechanism 258 to prevent the undesired removal of optional bobbin 260 from lock mechanism 258.

Bobbin 260 includes a keyhole 308 that is shaped to slidably receive optional key 262. As shown in FIG. 7, optional key 262 includes a body 310 and the tang 312 that is offset from body 310 by a stem 314. Body 310 is shaped to be easily manipulated by hand whereas tang 312 and stem 314 are shaped to slidably cooperate with a tortuous passage through bobbin 260 to operatively interact with plunger 280 of lock mechanism 258.

Figure 9:
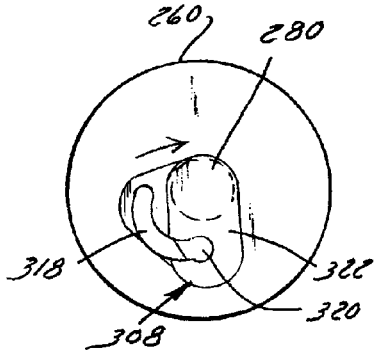
FIG. 9 is a cross-sectional view of the ground securing system taken along line 9-9 in FIG. 8.

Referring to FIG. 9, keyhole 308 of bobbin 260 includes in arcuate opening 318 that is shaped to slidably and rotationally cooperate with key 262. Opening 318 includes a passage 320 that slidably receives stem 314 of key 262. Keyhole 308 includes a bottom surface 322 that segregates keyhole 308 from direct axial engagement with plunger 280 which is positioned generally entirely behind surface 322. Referring to FIGS. 8 and 9, tang 312 and stem 314 of optional key 262 pass slidably through opening 318 formed in bobbin 260. Rotation of key 262 axially aligns tang 312 with plunger 280 such that further downward displacement of key 262 relative to bobbin 260 causes tang 312 to actuate plunger 280 and thereby allows balls 230, 232 to retract from interaction with channel 224 of ground engaging member 202. As such, bobbin 260 allows only keyed operation of plunger 280 and only keyed removal of lock mechanism 258 from ground engaging member 202.

As shown in FIG. 6, it is further appreciated that another selectively operable or removeable cover 301, like cover 264, or another supplemental cover can be provided to cooperate with the upward facing end of bobbin 260. Preferably, such a cover overlies passage 320 through bobbin 260 to protect the ability of passage 320 to smoothly cooperate with the tang and shaft of key 310. It is further appreciated that such a cover could be configured to cooperate with bobbin 260 in a manner that also accommodates storage of optional key 310 therebehind. Understandably, leaving the key disposed in such a supplemental cover would negate the operational benefits attributable to the keyed operation of lock mechanism 258 but would provide beneficial protection of the key system from collection of debris and in low security applications would provide user with functionally keyless operation. Preferable, the key would removably cooperate with such a supplemental cover of bobbin 260. Alternatively, it is further envisioned that cover 301 could be constructed of a rubber type material to allow user interaction with key 310 via direct interaction with cover 301 without removing cover 301 from bobbin 260. As shown in FIG. 6, cover 301 includes a moveable cover or lid 303 that is movable to selectively expose a passage 305 formed through cover 301. Passage 305 is preferably shaped to tolerate the full range of operable motion of key 262 when the key is engaged with the bobbin 260 positioned therebehind.

Each of the embodiments described above provide a convenient and economical manner of selectively securing structures to a ground surface. The loose but secure interaction of the clamp member with the ground securing member provides a highly adaptable and versatile ground mounting system. The non-rigid but secure mounting of such structures further reduces the detrimental affects attributable to unintended or undesired human interaction with the respective secured structures. The conveniently removable but secure nature of the interaction of the ground engaging member with the lock mechanism allows for quick and convenient reconfiguration or movement of devices intended to be secured to the ground.

Therefore, one embodiment of the invention includes a mounting system for selectively fixing structures to a ground surface. The mounting system includes a ground engaging member having a first end that is adapted to guide the ground engaging member into a ground surface and a second end that is adapted to be positioned proximate an upper surface of the ground surface. Preferably, the second end of the ground engaging member is positioned proximate an upper layer of the ground surface. A lock assembly removably engages the second end of the ground engaging member. The mounting system includes a clamp body that is constructed to extend in a lateral direction relative to a longitudinal axis of the ground engaging member. The clamp body is further constructed to be removable from the ground engaging member only when the lock assembly is disengaged therefrom.

Another embodiment of the invention usable with one or more of the features described above includes a ground clamp assembly. The ground clamp assembly includes a ground member that is constructed to be driven into the ground. A lock member is selectively securable to the driven member. A clamp member extends in an outward direction from the ground member, is shaped to cooperate with a structure to be secured, and is selectively secured to the ground member by the lock member to prevent undesired translation of the structure to be secured relative to the ground surface.

Another embodiment of the invention that is usable with one or more of the above features includes a method of selectively securing a structure to a ground surface. The method includes driving a ground member into the ground. A clamp body is aligned with the ground member to interfere with the structure to be secured. A removable lock engages the ground member to secure the clamp body to the ground member and thereby securing the structure relative thereto.

From the foregoing it is understood that numerous modifications and variations can be effectuated without departing from the spirit and scope of the present invention. It is further understood that no limitation with respect to the specific embodiments illustrated is intended or should be inferred. The disclosure is intended to cover all such modifications as fall within the scope of the claims.

What is claimed:

1. A mounting system for selectively fixing a soccer goal to a ground surface, comprising:

a ground engaging member having a longitudinal axis, a first end adapted to guide the ground engaging member into the ground surface and a second end adapted to be positioned proximate an upper surface of the ground surface;

a lock assembly that removably engages the second end of the ground engaging member, and having a longitudinal axis parallel to the longitudinal axis of the ground engaging member when the lock assembly is engaged with the ground engaging member, wherein the lock assembly includes a movable plunger and ball assembly, the plunger being movable in a direction aligned with the longitudinal axis of the ground engaging member and wherein the ball engages a groove formed in the ground engaging member to secure the lock assembly to the ground engaging member, and further including a key having a body and a tang, the key configured to cooperate with the lock assembly so that the body of the key is isolated from the plunger and the tang engages the plunger to manipulate the position of the ball;

a clamp body having a top surface and bottom surface and configured to extend in a lateral direction relative to the longitudinal axis of the ground engaging member, and further including an opening extending from the top surface to the bottom surface such the lock assembly is capable of engaging the ground engaging member through the opening and the clamp body is configured to be removable from the ground engaging member only when the lock assembly is disengaged from the ground engaging member; and wherein the clamp body further comprises a first portion having a substantially planar shape, and a second portion having a substantially arcuate shape, the second portion engaging a ground bar of the soccer goal to secure the ground bar under the second portion of the clamp body.

2. The mounting system of claim 1 wherein a tip of the second end of the ground engaging member is no higher than the ground surface when the ground engaging member is fully engaged with the ground surface.

3. The mounting system of claim 1 wherein the clamp body is allowed restricted lateral movement when the lock assembly is engaged with the ground engaging member.

4. The mounting system of claim 1 wherein the ground engaging member includes an elongate body and at least one flute helically wound about the elongated body.

5. The mounting system of claim 1 wherein the clamp body is capable of rotating about the longitudinal axis of the ground engaging member.

6. The mounting system of claim 1 further comprising a cavity formed in the second end of the ground engaging member and a contour formed in the cavity that cooperates with a driver for driving the ground engaging member element relative to the ground surface.

7. The mounting system of claim 6 further comprising a screw blade wound about an outside of the ground engaging member such that rotation of the ground engaging member in a first direction screws the ground engaging member into the ground surface and rotation in a second direction, opposite the first direction, screws the ground engaging member out of the ground surface.

8. The mounting system of claim 1 further comprising a cap engaged with the second end of the ground engaging member.

9. The mounting system of claim 8 wherein the cap includes a movable cover.

* * * * *